US005143759A

United States Patent [19]

Saito et al.

[11] Patent Number: 5,143,759

[45] Date of Patent: Sep. 1, 1992

[54] METHOD AND APPARATUS FOR APPLYING AN EMULSION LAYER TO PHOTOGRAPHIC PLATES INCLUDING PIVOTING CONVEYANCE ROLLERS

[75] Inventors: Hiroki Saito; Seiji Ishizuka, both of Kanagawa, Japan

[73] Assignee: Fuji Photo Film Co., Ltd., Kanagawa, Japan

[21] Appl. No.: 727,741

[22] Filed: Jul. 10, 1991

[30] Foreign Application Priority Data

Jul. 13, 1990 [JP] Japan ..... 2-185860

[51] Int. Cl.[5] ..... B05D 1/30

[52] U.S. Cl. ..... 427/420; 118/407; 118/412; 118/DIG. 4; 118/703

[58] Field of Search ..... 118/407, 412, DIG. 4, 118/703; 427/420; 198/861.2, 861.3, 861.5

[56] References Cited

U.S. PATENT DOCUMENTS 3,303,816 2/1967 Lauring ..... 118/DIG. 4
3,756,195 9/1973 Mercier ..... 118/412
4,380,967 4/1983 Matt ..... 118/703
4,821,870 4/1989 Simelunas et al. ..... 198/861.5
4,851,268 7/1989 Kozak ..... 427/420
4,922,851 5/1990 Morikawa et al. ..... 427/420

*Primary Examiner*—Shrive Beck
*Assistant Examiner*—Katherine A. Bareford
*Attorney, Agent, or Firm*—Sughrue, Mion, Zinn, Macpeak & Seas

[57] ABSTRACT

A method and an apparatus of manufacturing a photographic plate of glass using a device in which an elastic flexible hanger is provided at the bottom of a liquid feeder located over the movement passage for the base of the plate, and the base is moved into contact with the hanger at the lower end thereof so that a liquid flowing out from the feeder is applied to the base. The base and the hanger are kept out of contact with each other until the leading edge of the base passes under the hanger. The base and the hanger are then put into contact with each other after the leading edge of the base has passed under the hanger so that the application is started. The base and the hanger are subsequently put out of contact with each other immediately before the liquid is applied to the base at the trailing edge thereof.

4 Claims, 2 Drawing Sheets

METHOD AND APPARATUS FOR APPLYING AN EMULSION LAYER TO PHOTOGRAPHIC PLATES INCLUDING PIVOTING CONVEYANCE ROLLERS

BACKGROUND OF THE INVENTION

The present invention relates to a method and an apparatus for manufacturing a photographic plate having a glass base and a silver halide emulsion layer thereon, and more particularly relates to a method for manufacturing a photographic plate which has a glass base and a silver halide emulsion layer thereon and which can be used for various photomasks.

A photographic plate having a glass base and a silver halide emulsion layer thereon is high in dimensional stability. For that reason, such a plate is often used for a photomask for an integrated circuit, which is required to be high in accuracy, a shadow mask for a cathode-ray tube, a lead frame, or various display units. In a process in which a liquid, namely, a photographic photosensitive silver halide emulsion, is applied to the glass base to manufacture the photographic plate, an appropriate quantity of the liquid is coated on the glass base, and the base is thereafter rapidly rotated so that the liquid is distributed to a desired thickness over the surface of the base. This process is of the spin type.

In another process, an elastic flexible hanger (hereinafter referred to as solid curtain), such as a plastic sheet, a foil, paper or a cloth, is attached to the bottom of a liquid feeder disposed over the moving glass base, and the base is put into contact with the lower end of the solid curtain so that the liquid flowing out from the liquid feeder is applied to the base. The latter process is of the solid curtain type.

In these conventional processes, however, the liquid has a tendency to cling to the end or side face of the glass base during the application of the liquid thereto and then separate from the base during the conveyance or development of the plate, while another part of the separated liquid clings to the mask pattern making portion of the surface of the glass base, thus resulting in a serious defect. In the application process of the spin type, the liquid is likely to cling to the glass base on the end and side faces thereof along the entire periphery of the base. In the application process of the solid curtain type, the liquid is likely to cling to the glass base on the leading and trailing end faces thereof. In each of the processes, the liquid clings even around to the lower surface of the glass base in some case.

SUMMARY OF THE INVENTION

Accordingly, it is an object of the present invention to provide a method for manufacturing a photographic plate of glass through practicing a process of the solid curtain type, in which a liquid, which is an emulsion, does not cling to the peripheral and lower surfaces of the glass base of the plate along the entire periphery thereof at all so as to result in a serious defect such as one resulting from the separation of the clinging liquid.

In the conventional application process of the solid curtain type, the positional relationship between the liquid feeder and the upper surface of the glass base is set so that the solid curtain and the glass base are kept in appropriate contact with each other. The optimal positions of the liquid feeder and the upper surface of the glass base depend on conditions such as the quality and form of the solid curtain and the viscosity and applied quantity of the liquid, but are such that the lower end of the curtain is located a distance of about 0 to 10 mm down from the upper surface of the glass base when the curtain is in a free state.

The present inventors analyzed the cause of the above-mentioned problem in the conventional application process of the solid curtain type. As a result, they found out that the solid curtain is likely to come into contact with the leading and trailing end faces of the glass base due to the positional relationship between the solid curtain and the glass base, the applied liquid is therefore likely to cling to the end faces of the base, the liquid supplied from the liquid feeder during the period from the end of the application of the liquid to the preceding glass base to the arrival of the leading edge of the following glass base accumulates on the solid curtain at the lower end thereof so as to be likely to cling to the leading end face of the glass base, and the liquid accumulating on the mutual contacting portions of the solid curtain and the upper surface of the glass base during the application of the liquid to the base is likely to cling to the trailing end face of the base and spread on the face when the curtain is put out of contact with the base at the trailing edge thereof.

The process of the solid curtain type has a feature that since the right and left side faces of the glass base do not come into contact with the solid curtain, the applied liquid is not likely to cling to the side faces. To make the applied liquid more unlikely to cling to the right and left side faces of the glass base, the liquid supply width of the liquid feeder or the width of the solid curtain is made smaller than the width of the glass base.

In the method provided in accordance with the present invention, the photographic plate of glass is manufactured using a device in which an elastic flexible hanger is provided at the bottom of a liquid feeder located over the movement passage for the glass base of the plate, and the glass base is moved into contact with the hanger at the lower end thereof so that the liquid flowing out from the feeder is applied to the base. The method is characterized in that the glass base and the hanger are kept out of contact with each other until the leading edge of the base passes under the hanger, the base and the hanger are put into contact with each other after the leading edge of the base has passed under the hanger so that the application is started, and the base and the hanger are put out of contact with each other immediately before the liquid is applied to the base at the trailing edge thereof.

DESCRIPTION OF THE PREFERRED EMBODIMENTS

Preferred embodiments of the present invention are hereafter described in detail with reference to the drawings attached hereto. These embodiments include a method and a device for manufacturing a photographic plate of glass through applying a liquid to the glass base of the plate.

Figure 1:
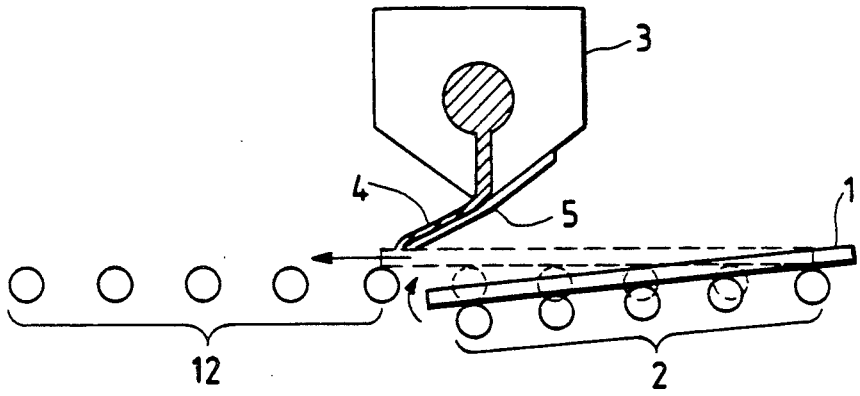
FIG. 1 is a schematic view of an application device of a preferred embodiment of the present invention and illustrates the operation of an upstream conveyance rollers.
Figure 2:
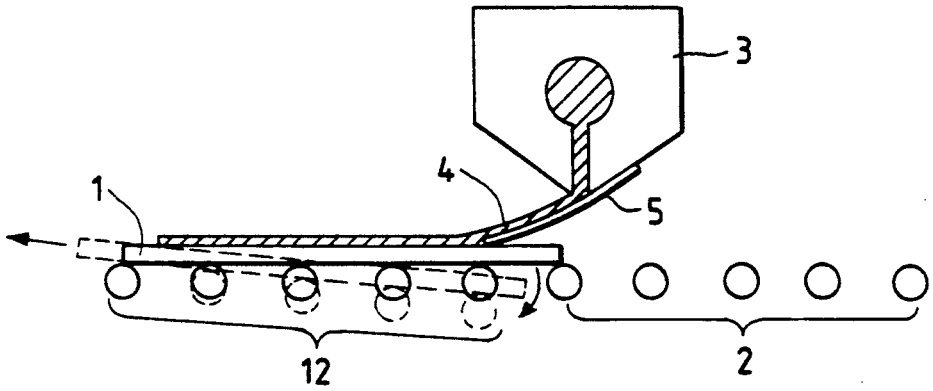
FIG. 2 is a schematic view of the application device and illustrates the operation of a downstream conveyance rollers.

FIG. 1, which is a schematic view of an application device constructed in accordance with a preferred embodiment of the invention, illustrates the case where upstream conveyance rollers are held in the swung-down positions thereof to move the upper surface of a glass base to a height lower than the lower end of a solid curtain before the leading edge of the glass base passes under the lower end of the curtain toward the start of application of a liquid to the base, and where the rollers are swung up to put the upper surface of the base into contact with the curtain at the lower end thereof after the leading edge of the base has passed under the lower end of the curtain. FIG. 2 is a schematic view of the application device, and shows the case where downstream conveyance rollers are swung down to put the upper surface of the glass base out of contact with the solid curtain immediately before the trailing edge of the base reaches the solid curtain during the application.

Shown in the drawings are a base plate upstream conveyance rollers 2, a liquid feeder 3, an applied liquid 4, a solid curtain 5, a liquid receiver 6, and downstream conveyance rollers 12.

FIG. 1 shows the state where the liquid 4 begins to be applied to the glass base 1. The liquid 4 is supplied from a liquid feeder 3 and flows down in a solid curtain 5 so that the liquid is applied to the glass base 1 as the base is supported and conveyed by a series of upstream conveyance rollers 2. Before the leading edge of the glass base 1 reaches a position under the lower end of the solid curtain 5, the upstream conveyance rollers 2 are swung down as a whole about an appropriate upstream point so that the upper surface of the glass base descends to such a position as to be out of contact with the lower end of the solid curtain. After the leading edge of the glass base 1 has passed under the lower end of the solid curtain 5, the upstream conveyance rollers 2 are swung up as a whole to a normal position at an appropriate timing so that the upper surface of the glass base 1 comes into contact with the solid curtain at the lower end thereof and the liquid 4 begins to be applied to the upper surface of the base. The timing is determined through detecting the time of the passing of the leading edge of the glass base 1 by an appropriate upstream position and then predicting the time of the passing of the leading edge by the position under the lower end of the solid curtain 5.

FIG. 2 shows the state where the application of the liquid 4 to the glass base 1 is being completed. The glass base 1 is supported and conveyed by a series of downstream conveyance rollers 12 during the application of the liquid 4 to the base. Immediately before the trailing edge of the glass base 1 reaches the lower end of the solid curtain 5, the downstream conveyance rollers 12 are swung down as a whole about an appropriate downstream point so that the glass base is put out of contact with the lower end of the solid curtain. The timing of the swinging down of the rollers 12 is determined by detecting the position of the trailing edge of the glass base 1 similarly to the above-mentioned detecting of the passing of the leading edge thereof and then predicting the time the trailing edge of the base reaches the lower end of the solid curtain 5 on the basis of a signal generated upon the detection of such position.

Although in the above-described embodiment the conveyance rollers 2 and 12 are swung up and down about appropriate points, the present invention is not limited thereto but may be otherwise embodied so that the rollers are translated up and down or the liquid feeder 3 and the solid curtain 5 are moved up and down.

The application start point of the glass base 1 can be optionally changed in terms of the timing of the swinging up of the upstream conveyance rollers 2, which is based on the detection of the position of the leading edge of the glass base.

Figure 3:
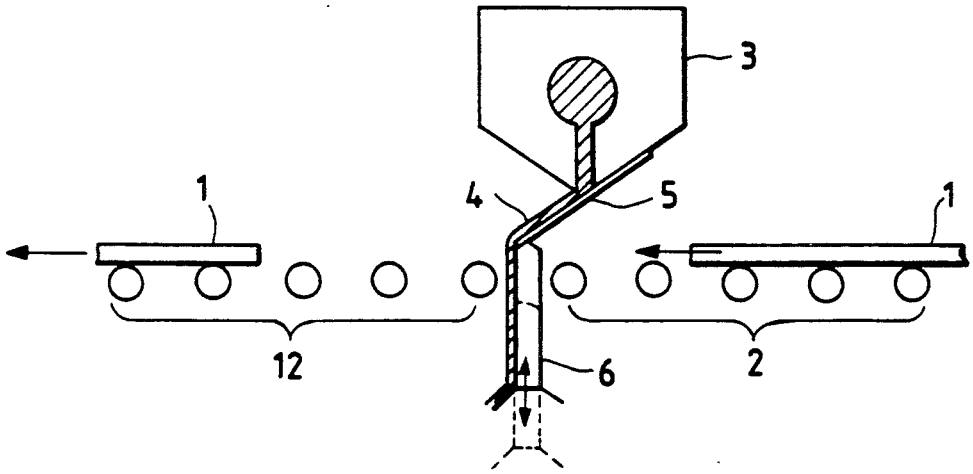
FIG. 3 is a schematic view of an application device using a liquid receiver.

It is desirable that the leading edge of the applied liquid 4 on the glass base 1, which corresponds to the start of the application of the liquid thereof, be rectilinear. However, the present inventors have found that since the liquid 4 supplied from the liquid feeder 3 during the period from the end of application of the liquid to one glass base to the start of the application thereof to another glass base tends to accumulate nonuniformly on the solid curtain 5 at the lower end thereof, the leading edge of the liquid on the latter glass base is likely to be wavy. This problem is solved by providing a liquid receiver 6 which is put into contact with the solid curtain 5 at the lower end thereof during the time the liquid 4 is not being applied to the glass base 1 so as to assist the liquid to flow down from the curtain, as shown in FIG. 3.

The liquid receiver 6 is moved up and down. When the liquid 4 is not applied to the glass base 1, the liquid receiver 6 is moved up into contact with the solid curtain 5 to assist the liquid to flow down therefrom. When the liquid 4 is applied to the glass base 1, the liquid receiver 6 is moved down out of contact with the solid curtain 5 into such a retracted position that the receiver does not hinder the movement of the glass base 1. Since the liquid receiver 6 is moved down immediately before the leading edge of the glass base 1 reaches the position under the lower end of the solid curtain 5, the liquid 4 supplied from the liquid feeder 3 does not accumulate nonuniformly on the solid curtain at the lower end thereof, whereby the leading edge of the applied liquid on the glass base, which corresponds to the start of the application of the liquid thereto, is nearly rectilinear.

The trailing edge of the applied liquid 4 on the glass base 1, which corresponds to the end of the application of the liquid thereto, can be made nearly rectilinear by separating the glass base from the solid curtain 5 at a relatively high speed. However, the speed depends on the quality of the solid curtain 5. If the solid curtain 5 is made of a water-impermeable material such as a plastic sheet and a foil, the trailing edge of the applied liquid on the glass base 1 can be easily made rectilinear. If the solid curtain 5 is made of a water-permeable material such as paper and a cloth, the trailing edge of the applied liquid on the glass base 1 cannot easily be made rectilinear. The reasons for these facts are believed to be that the liquid 4 which accumulates at the place where the solid curtain 5 and the upper surface of the glass base 1 contact each other during the application of the liquid to the glass base is larger in quantity and thus is apt to have a more nonuniform thickness on the base after the separation of the base from the curtain when the curtain is made of the water-permeable material than when the curtain is made of the water-impermeable material.

Figure 4:
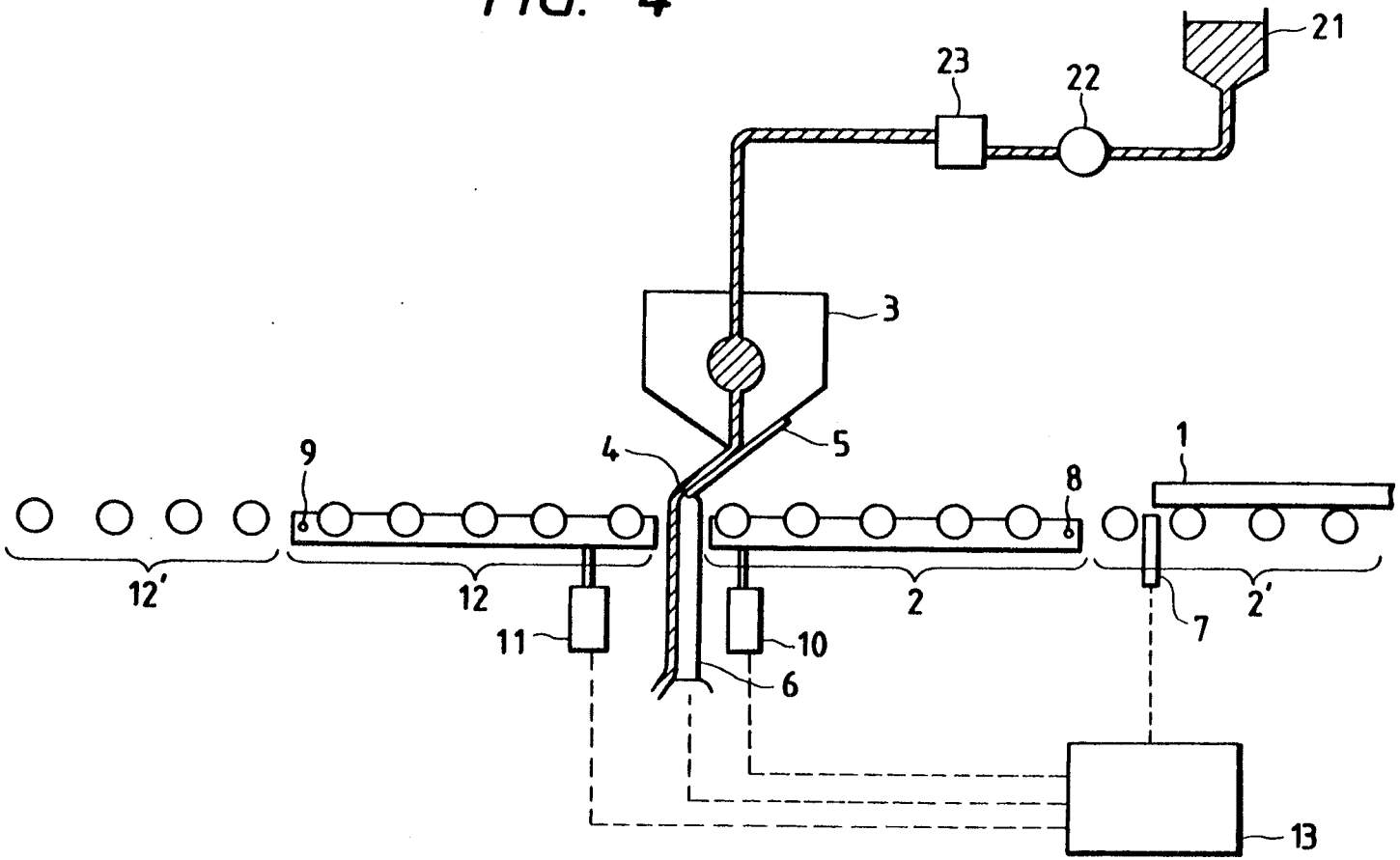
FIG. 4 is a schematic view of a device of manufacturing a photographic plate of a preferred embodiment of the present invention.

FIG. 4 is a schematic view showing an apparatus for manufacturing a photographic plate according to an embodiment of the present invention.

A coating apparatus comprises the liquid feeder 3, the solid curtain 5 and the liquid receiver 6, to which have a function as mentioned with reference to in FIGS. 1 and 2. The liquid 4 is sent from a stock-tank 21 by a feeding pump 22, and supplied to the liquid feeder 3 through a filter 23 to flow down on the solid curtain 5.

Upstream conveyance rollers comprise rollers 2 and 2'. The former rollers 2 are disposed in a continuous frame over a range longer than the longest length of a photographic plate of glass which is coated in all length, and the entire of the rollers 2 swing at the fulcrum of an axis 8.

Downstream conveyance rollers comprise rollers 12 and 12'. The former rollers 12 are disposed in a continuous frame over a range longer than the longest length of the photographic plate of glass which is coated in all length, and the entire of the rollers 12 swings at the fulcrum of an axis 9.

An air-cylinder, an oil-cylinder, or an eccentric can are preferably used as swinging apparatuses 10 and 11 for swinging the upstream conveyance rollers 2 and the downstream conveyance rollers 12. However, the swinging apparatuses are not restricted to the above devices, but may be any means that swings conveyance rollers 2 and 12 smoothly in a short time.

A base detecting device 7 detects the timing when the leading or the trailing edge of the base 1 passes the base detecting device 7, and is realized by using a conventional system such as an optical system, an ultrasonic system, and a contact type micro-switching system.

When the detecting device 7 detects the leading or trailing edge of the base having passed the detecting device, a detecting signal is output. The detecting signal and the conveying rate of the base are used to calculate the timing for swinging the respective conveyance rollers 2 and 12.

When the liquid receiver 6 as described with reference to FIG. 3 is used, the timing of the up-and-down operation is calculated based on the signal showing that the leading or the trailing edge of the base has passed the detecting device 7, and is set optimally.

A programmable controller is preferably used as a controller 13 which controls the swing of the upstream and downstream conveyance rollers and the up-and-down operation of the liquid receiver based on the signal showing the leading/trailing of the base.

COMPARATIVE EXAMPLE

A liquid, namely, a photographic photosensitive material of 10 cp in viscosity and 48 dyne/cm in surface tension, was applied to a glass base 50 cm in length and 2 mm in thickness by an application device constituted as shown in FIG. 3 but whose conveyance rollers were not swingable. The film of the applied liquid on the glass base was 50 cm in width and 100 μm in thickness. Such glass bases were continuously conveyed at a speed of 3.0 m/min and an interval of 10 cm between the bases. The solid curtain of the device was a sheet made of polyethylene terephthalate measuring 20 mm in length and 100 μm in thickness. The lower end of the solid curtain was located a distance of 1 mm down from the upper surface of the glass base when the curtain was in a free state. The liquid receiver of the device was made of stainless steel. The liquid receiver was separated from the solid curtain when the trailing edge of the glass base being conveyed toward the lower end of the curtain was a distance of 20 mm from the lower end. It was found that the end faces of the glass base were wetted with the liquid along the whole leading and whole trailing edges of the glass base.

EXAMPLE OF THE INVENTION

The same liquid was applied to the same glass base as the Comparative Example using an application device as shown in FIG. 4. Before the leading edge of the glass base passed under the lower end of the solid curtain, the upstream conveyance rollers 2 were in the swung-down positions thereof so that the upper surface of the base moved at a height which was 5 mm lower than the lower end of the curtain. When the leading edge of the glass base moved a length of 5 mm from the lower end of the solid curtain after passing under the lower end, the upstream conveyance rollers 2 were swung up so that the upper surface of the glass base came into contact with the curtain at the lower end thereof. When the trailing edge of the glass base being conveyed in contact with the solid curtain was at a distance of 5 mm from the curtain, the downstream conveyance rollers 12 were swung down. The upstream and the downstream conveyance rollers 2 and 12 were operated so that the glass base was moved up and down at a speed of 5 cm/sec at the time of the start and end of the application of the liquid to the base. The other conditions of the application were the same as in the Comparative Example.

It was found that the end faces of the glass base were not wetted with the liquid at the leading and trailing edges of the glass base, and the leading and trailing edges of the applied liquid on the glass base were nearly rectilinear.

According to the present invention, a base plate is provided with rectilinear liquid-unapplied areas around a liquid-applied area. Also, the end faces of the base plate are prevented from being wetted with a liquid at the leading and trailing edges of the base plate when the liquid is applied to the plate through the use of a solid curtain. For that reason, there is avoided the clinging of a film of the applied liquid to the end face of the base plate and the subsequent separation therefrom to result in a serious defect in a photomask or the like made from the base plate and the liquid.

What is claimed is:

1. In a method of manufacturing a photographic plate of glass using an apparatus in which an elastic flexible hanger is provided at the bottom of a liquid feeder located over the movement passage for the base of said plate, and said base is moved into contact with said hanger at the lower end thereof so that a liquid flowing out from said feeder is applied to said base, the improvement wherein: said base and said hanger are kept out of contact with each other until the leading edge of said base passes under said hanger; said base and said hanger are put into contact with each other after the leading edge of said base has passed under said hanger so that said application is started; and said base and said hanger are put out of contact with each other immediately before said liquid is applied to said base at the trailing edge thereof;

wherein said base is conveyed past said hanger with a set of upstream rollers and a set of downstream rollers located respectively upstream and downstream of said hanger; and wherein said step of putting said base and said hanger into contact with each other comprises swinging said upstream rollers around a first predetermined axis, and said step of putting said base and said hanger out of contact with each other comprises swinging said downstream rollers around a second predetermined axis.

2. In a method of manufacturing a photographic plate of glass using a apparatus in which an elastic flexible hanger is provided at the bottom of a liquid feeder located over the movement passage for the base of said plate, and said base is moved into contact with said hanger at the lower end thereof so that a liquid flowing out from said feeder is applied to said base, the improvement wherein: said base and said hanger are kept out of contact with each other until the leading edge of said base passes under said hanger; said base and said hanger are put into contact with each other after the leading edge of said base has passed under said hanger so that said application is started; and said base and said hanger are put out of contact with each other immediately before said liquid is applied to said base at the trailing edge thereof;

wherein said base is conveyed past said hanger with a set of upstream rollers and a set of downstream rollers located respectively upstream and downstream of said hanger; and wherein said step of putting said base and said hanger into contact with each other comprises raising said upstream rollers from a lowered position thereof, and said step of putting said base and said hanger out of contact with each other comprises lowering said downstream rollers from a raised position thereof.

3. An apparatus for manufacturing a photographic plate of glass in which an elastic flexible hanger is provided at the bottom of a liquid feeder located over the movement passage for the base of said plate; and said base plate is moved into contact with said hanger at the lower end thereof so that a liquid flowing out from said feeder is applied to said base, comprising a means for determining the timing when a leading edge of said base passes under the lower end of said hanger and when a trailing edge of said base passes under the lower end of said hanger; and a control means for moving said base up and down to put said base into and out of contact with said hanger.

4. An apparatus according to claim 3, wherein said control means is a means for swinging a series of rollers for supporting said base at the bottom thereof and conveying said base.

* * * * *